US006305040B1

(12) United States Patent
Myler

(10) Patent No.: US 6,305,040 B1
(45) Date of Patent: Oct. 23, 2001

(54) ACUPRESSURE PILLOW APPARATUS AND METHOD

(76) Inventor: Scott G. Myler, 354 E. Heather Rd., Orem, UT (US) 84057

( * ) Notice: Subject to any disclaimer, the term of this patent is extended or adjusted under 35 U.S.C. 154(b) by 0 days.

(21) Appl. No.: 09/324,746

(22) Filed: Jun. 3, 1999

Related U.S. Application Data

(60) Provisional application No. 60/087,888, filed on Jun. 3, 1998.

(51) Int. Cl.[7] ..... A61H 39/00
(52) U.S. Cl. ..... 5/636; 5/944; 5/630
(58) Field of Search ..... 5/630, 632, 636, 5/944, 652, 633

(56) References Cited

U.S. PATENT DOCUMENTS

| | | | | |
|---|---|---|---|---|
| 1,250,392 | * | 12/1917 | Vance | 607/108 |
| 1,981,379 | * | 11/1934 | Thomson et al. | 606/237 |
| 4,210,134 | * | 7/1980 | Okazaki et al. | 5/630 X |
| 5,163,193 | * | 11/1992 | Whitmore | 5/630 X |
| 5,197,975 | * | 3/1993 | Mombrinie | 5/601 X |
| 5,481,771 | * | 1/1996 | Burk, IV | 5/636 |
| 5,724,687 | * | 3/1998 | Kim | 5/944 |
| 5,819,743 | * | 10/1998 | McMillin et al. | 5/636 X |
| 5,820,573 | * | 10/1998 | Ramos | 5/99.4 X |
| 5,911,656 | * | 6/1999 | Futagami | 5/636 X |

OTHER PUBLICATIONS

"*Acupressure's Potent Points*" Michael Reed Gach, pp. 26–27, 36–37, 40–41, 54–55, 60–61, 64–65, 76–77, 90–91, 98–99, 114–115, 132–133, 138–139, 144–145, 152–153, 162–163, 178–179, 186–189, 192–193, 198–199, 202–203, Dec. 1990.

Diagram from "Oriental Bodywork and Fibromyalgia Syndrome", p. 16.

* cited by examiner

*Primary Examiner*—Michael F. Trettel
*Assistant Examiner*—Robert G. Santos

(57) ABSTRACT

An Acupressure pillow provides selective pressure by location and force applied to a body of a user. By selection of a body member, a location on that body member, and a pressure point thereat, an acupressure pillow may be used for gauging and applying a localized, selective force or pressure at a designated point for a user. For example, headaches have been attributed to various causes including stress, tension, and so forth, all of which may result in involuntary tightening of muscles. Tightening of muscles affects blood flow. Restriction of blood flow may be responsible for certain headache pain. By applying a steady, predictable, reliable, continuing pressure at a designated acupressure location on member of a body of a user, muscles may be relaxed. Massage therapy requires knowledgeable application of pressure and motion. An acupressure pillow applies steady pressure, to which the body will become accustomed and relax. The actual continual application of pressure may tend to speed relaxation better than unpredictable motion such as vibration and other techniques used in the art.

16 Claims, 6 Drawing Sheets

ACUPRESSURE PILLOW APPARATUS AND METHOD

RELATED APPLICATION

This patent application is a continuation of U.S. provisional patent Ser. Np. 60/087,888 filed on Jun. 3, 1998 for Acupressure Pillow Apparatus and Method.

BACKGROUND

1. The Field of the Invention

This invention relates to physical therapy and, more particularly, to novel systems and methods for selectively applying pressure to designated locations on a member of a human body in order to provide relaxation of muscles for therapeutic effect.

2. The Background Art

Massage therapy has been known for several years, even decades or more. Within the established medical community within the United States and other countries of the world, massage therapy has gained increased recognition for the therapeutic benefits available by selective application of regular motion and pressure to muscles of the body in order to relieve tension and provide associated benefits.

Chiropractic medicine has gained favor as persons treated thereby become satisfied that they feel better. Regardless of the school that one subscribes to, feeling healthy is one ultimate measure of success of any treatment. In Asian countries, ancient arts have been practiced that have only recently become known, acknowledged, applied, investigated, and the like, within the Western Hemisphere. For example, acupuncture involves the use of carefully placed and manipulated needles for providing relief of various symptoms.

Similarly, another ancient art involves the use of massage, careful movement and pressure over a region of muscle in the body in order to relax the muscle. Athletic trainers during the Olympic Games used numerous massage therapists to prepare athletes for competition and to relax and promote healing in athletes coping with injuries.

Pressure is a mechanism that has been used for numerous benefits. In the cardiovascular system of the human body, pressure is known to be useful in constricting blood flow from wounds. It is also known that the muscular structure of the human body is interwoven with the vascular system carrying blood therethrough in order to pass nutrients and waste. Pressure applied to key points on the surface of the skin has been viewed as helpful in providing relief for a variety of symptoms.

As a practical matter, massage therapy, and acupressure may be related. As an individual works by finger pressure in an area of a bodily member that appears to respond or provide a response to the manipulating pressure, an individual may feel relaxation in the affected muscles. Thus, chiropractic treatment, massage therapy, acupressure, and the like, may provide relaxation of muscles, which relaxation may provide any other benefits associated therewith. One difficulty that is created by the current mechanisms for delivering such massage therapy or relaxation therapy by application of various massage techniques, is the absence of a skilled practitioner.

For example, quick tapping with fingers is sometimes used in order to stimulate muscles. Brisk rubbing may use friction to stimulate the flesh near the skin of a user and the skin itself. Slow, kneading motion using the thumbs and fingers along with the heel of the hand to work and squeeze large muscle groups firmly is also used. Application of pressure from a thumb, finger, palm, side of the hand, or knuckle may also be used. Since all of these manual applications of pressure are adapted to use by skilled practitioners, the growth of such techniques in popularity creates a shortage of practitioners.

Nevertheless, a steady pressure applied in an appropriate location, may be one effective technique for relaxation. What is needed is an apparatus and method that can be applied easily by an unskilled user. For example, if a user has a desire or need to relax, it would be an improvement in the art to provide an apparatus that is sized and structured to effectively apply pressure in a proper location, in a proper degree, and in a proper direction to provide the relaxation desired. It would be an improvement in the art to provide an apparatus and method by which a user could simply position a bodily member within or upon an apparatus that could apply proper pressure to proper muscles or muscle groups in order to provide relaxation.

BRIEF SUMMARY AND OBJECTS OF THE INVENTION

In view of the foregoing, it is a primary object of the present invention to provide an apparatus and method for applying a selective pressure at a designated location in a manner that will be easily replicated by a user with a minimal amount of skill.

Consistent with the foregoing objects, and in accordance with the invention as embodied and broadly described herein, an apparatus and method are disclosed, in suitable detail to enable one of ordinary skill in the art to make and use the invention. In certain embodiments, an apparatus and method in accordance with the present invention may include a pillow-like apparatus that may be effective to position or lift a bodily member to a proper position for application of localized pressure.

The apparatus may include one or more pressurizing elements protruding away from the pillow's outer surface or bulk outer expanse, in order to apply a selective and increased pressure distributed over a selected portion of the bodily member being affected. The apparatus may be used at rest, eliminating any need for a user to maintain any particular skill, strength, or the like. Thus, young or elderly patients need not be so physically fit as a massage therapist in order to obtain the benefits of the apparatus and method.

In one embodiment, the pressurizing elements of the apparatus may be designed to provide pre-selected locations, forces, and areas. For example a protrusion may be spaced from another protrusion, or from some gauge point, a selected distance effective to position the protrusion properly for a desired effect. The protrusion may then apply the proper pressure to a proper location, designated and gauged on a specific member of a body of a user, in order to be effective. Pressure may produce, for example, relaxation in a desired muscle or muscle group.

In one embodiment, multiple protrusions may extend away from the bulk expanse of an apparatus in order to provide self-location of the protrusions against the body of a user. In one presently preferred embodiment, a "pillow" may be provided that contains a support for receiving and supporting the back of a user. Another portion of the pillow may provide substantial support for the head of the user. Over the bulk expanse of the pillow may be multiple pressure members for applying pressure to the upper central muscles of the back. Other pressurizing elements may be adapted to fit against the neck, producing pressure thereagainst.

In one such particular embodiment, upper pressurizing elements, with respect to the head, may be positioned just below the occipital portion of the skull, against the neck, in the hollow where the neck muscles contract away from the skull and toward the neck vertebrae. Pressure may be applied laterally, and forwardly (with respect to a user) against the neck muscles on either side. Accordingly, the symmetry of the neck and of the pillow may provide self-location of the pillow by a user.

Moreover, the lower pressurizing members may be adapted to fit in a location effective to press into the back muscles near the base of the neck. The pressurizing elements may be designed to a size, resilience, area, force, effective pressure, and so forth, effective to provide a gentle but effective pressure. Moreover, the lower pressurizing elements may be so located with respect to the upper pressurizing elements as to aid a user in gauging the position of the pillow device under the neck and shoulders.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 10, is not intended to limit the scope of the invention. The scope of the invention is as broad as claimed herein. The illustrations are merely representative of certain, presently preferred embodiments of the invention. Those presently preferred embodiments of the invention will be best understood by reference to the drawings, wherein like parts are designated by like numerals throughout.

One of ordinary skill in the art will, of course, appreciate that various modifications to the details of the Figures may easily be made without departing from the essential characteristics of the invention. Thus, the following description of the Figures is intended only by way of example, and simply illustrates certain presently preferred embodiments consistent with the invention as claimed.

Figure 1:
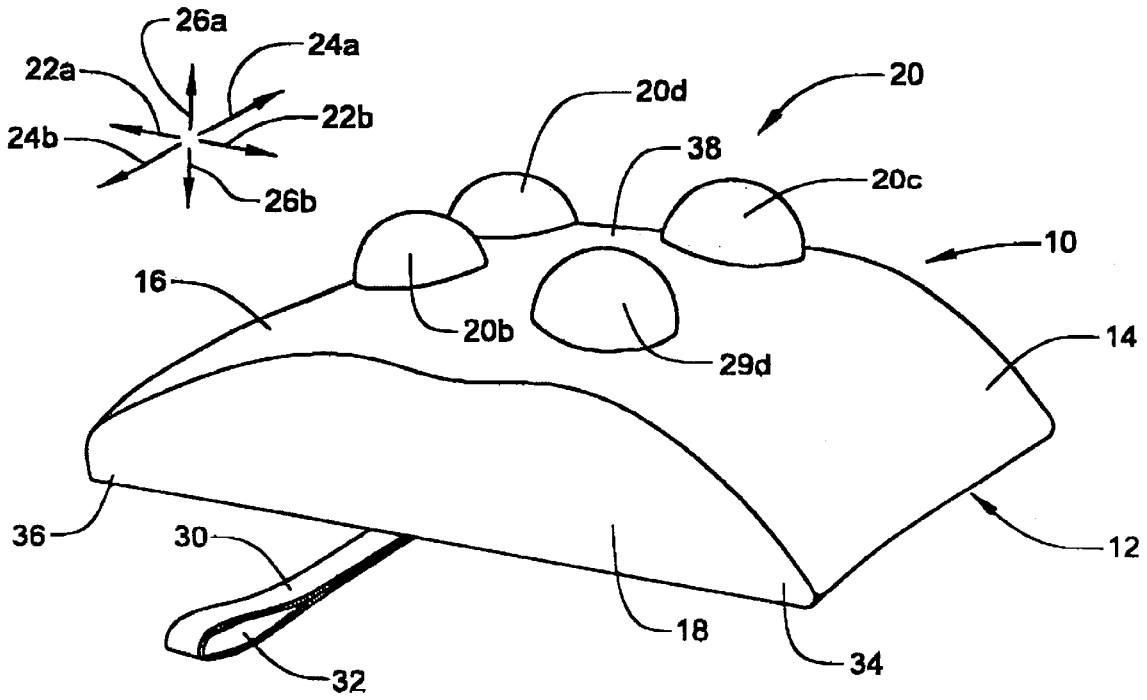
FIG. 1 is top quarter perspective view of one embodiment of an apparatus in accordance with the invention.
Figure 2:
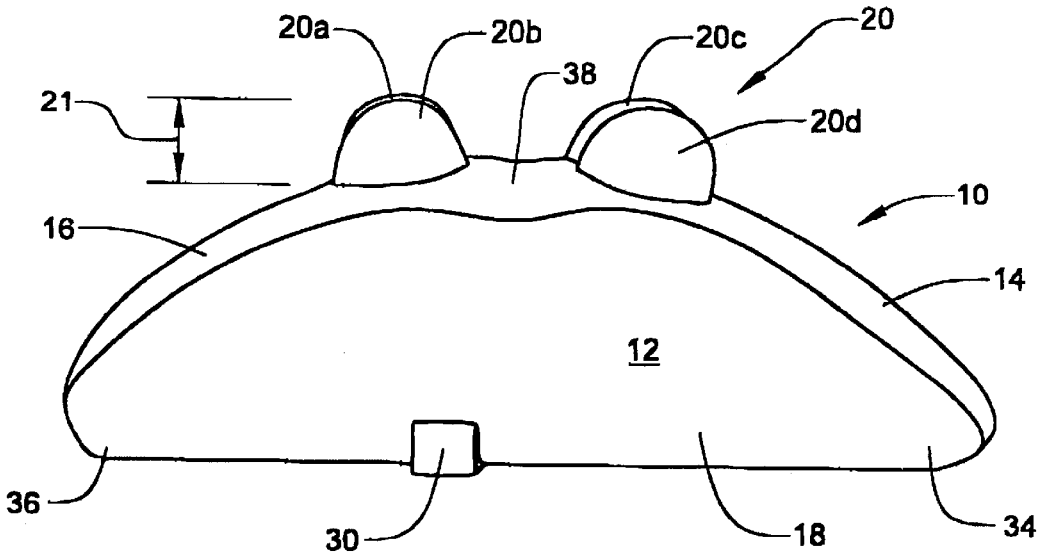
FIG. 2 is a side elevation view of the apparatus of FIG. 1.
Figure 3:
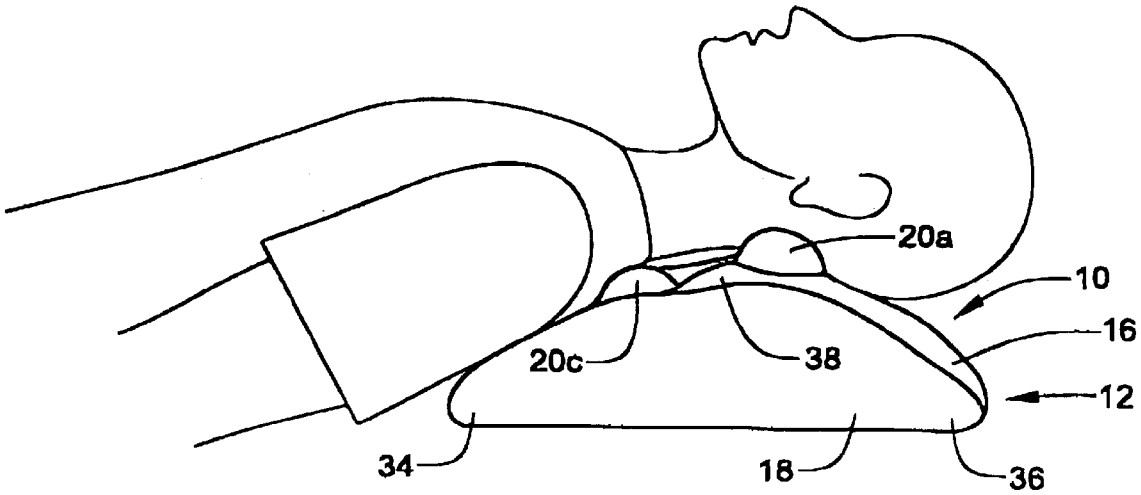
FIG. 3 is a side elevation view of the apparatus in FIG. 1 in use by a user.

Referring to FIG. 1, and to FIGS. 1–3, generally, an apparatus 10 may be formed to have a base 12. The base may include a body support portion 14 and an extremity support portion 16. The base 12 may have sides 18, or may taper down to contact a supporting surface, as appropriate for the bodily member to be supported thereby.

Pressure elements 20 (e.g. 20*a*, 20*b*, 20*c*, 20*d*) may protrude from the base 12 at selected locations. The pressure elements 20 are designed and positioned on the base 12 at locations selected to engage pressure points on a bodily member of a user. Each pressure element 20 may extend away from the base 12 a distance 21 selected to provide an appropriate pressure to an acupressure point associated with a bodily member. In one embodiment, the portion of a body that is closer to the center of mass is supported by the body support portion 14. Meanwhile, a distal portion of an extremity or other bodily member (comparatively farther from the center of mass) may rest and be supported by the extremity support portion 16.

Distances defined for discussing the manufacture and use of an apparatus 10 may include longitudinal directions 22 (22*a* is up, and 22*b* is down with respect to a user). A lateral direction 24 (24*a* is left, and 24*b* is right), and a transverse direction 26 (26*a* is forward, and 26*b* is backward) may be defined with respect to a user.

A handle 30 may attach to the apparatus 10, and particularly the base 12, in order to move the apparatus 10 easily. In one embodiment the handle 30 may be a strap 30 or loop 30 having an opening 32. Handles 30 may attach to opposite sides 18 of the base 12. A sufficiently large loop 30 on each side 18 of the base 12 may be easily grasped by a user for positioning the apparatus 10 easily with respect to a bodily member of a user.

In the longitudinal direction 22, a proximate end 34 is designed to be closer to the center of mass of the body of a user. The distal end 36 or opposite end 36 is designed and shaped to rest against a bodily member of a user away from the center of gravity of the body. The extremity support 16 may be higher or lower, with respect to a supporting surface, than the body support portion 14, depending on the body member to be affected. Extremity support portion 16 may be positioned higher (in a transverse direction 26) than the extremity support portion 14.

In one presently preferred embodiment of an apparatus 10 in accordance with the invention, the body support portion 14 is adapted to supporting the shoulders of a user near the neck and upper back. The extremity support portion 14 is adapted to support the neck and head. Accordingly, the crown 38 may be the highest portion, in a transverse direction 26, of the base 12, with the exception of the pressurizing elements 20.

Referring to FIG. 2, an elevation view of the apparatus 10 illustrates the expanse of the crown 38. Also the ends 34, 36 are shown in relative position. In certain selected embodiments, the body support portion 14, and the extremity support portion 16 may be curved non-linearly in the longitudinal direction 22, with curvature in a lateral direction 24, as well. The location of the pressurizing elements 20 may be selected in accordance with the bodily member to be supported by the apparatus 10. The directionality and area of pressure to be provided by the pressure elements 20 depends upon the size, location, and extension 21 of the pressure elements 20 with respect to the base 12.

Referring to FIG. 3, a user may rest on the apparatus 10 in order to apply selected pressure on a selected location (e.g. acupressure location) on a body member of a user. The extremity support 16 may be sloped at an angle selected to provide the proper placement of the bodily member distant from the main center of gravity of the body. Similarly, the body support portion 14 of the base 12 may be sloped at an angle designed to properly position the body to apply pressure from the pressure elements 20 to the selected bodily members.

In one embodiment, the base 12 may be formed predominantly of resilient material having a spring constant governing deflection thereof For example, in one embodiment, an elastomeric foam such as polyurethane may form the base 12, distributing localized stresses for comfort. Multiple layers having different spring constants may provide more deflection nearer the outer surface of the base 12, with stiffer layers (greater spring constant) positioned underneath for providing additional support. Thus, conformance to the body shape of a user, particularly relieving pressure around protruding bones, may result from softer upper layers. Underlying support may be maintained by stiffer layers within or below the outermost layers.

Figure 4:
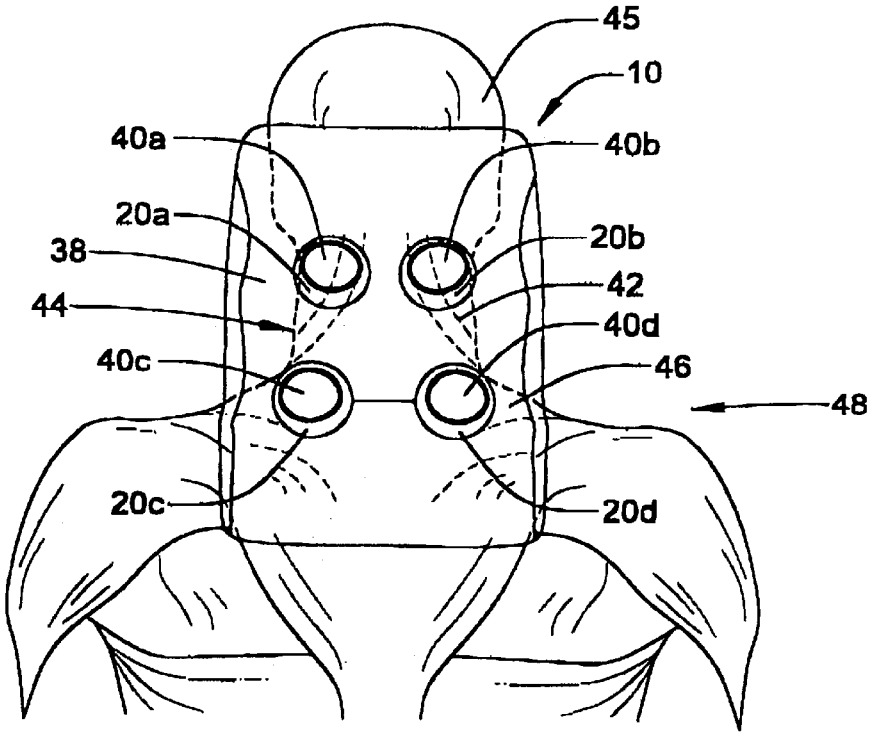
FIG. 4 is a schematic, bottom elevation view of an apparatus in accordance with the invention, illustrating application of pressure to regions of the back and neck of a user.

Referring to FIG. 4, the pressure elements 20 may apply pressure over selected regions 40. For example, the pressure regions 40*a*, 40*b*, 40*c*, 40*d* correspond to the respective pressure elements 20*a*, 20*b*, 20*c*, 20*d*. Pressure elements 20 may apply pressure in a lateral direction 24, a longitudinal direction 22, a transverse direction 26, or all of the above.

In one presently preferred embodiment, an apparatus 10 adapted for use in the shoulder and neck region of a user may avoid applying pressure in a longitudinal direction 22 against the skull 45 of a user. Pressure applied to flesh between a pressure element 20 and a bone structure close to the skin surface may result in inhibited circulation and discomfort. The pressurized regions 40 may be designed into the pressure elements 20, adapted to the particular size (dimension, bulk) of an individual user.

In the embodiment in FIG. 4, muscles 42 of the neck 44 may be pressurized just below the occipital portion of the skull, where the muscles typically form a hollow. Muscles 46 of the shoulders 48, in the upper back region, may be pressurized locally in the pressure regions 40*c*, 40*d* by the pressure elements 20*c*, 20*d* respectively.

Figure 5:
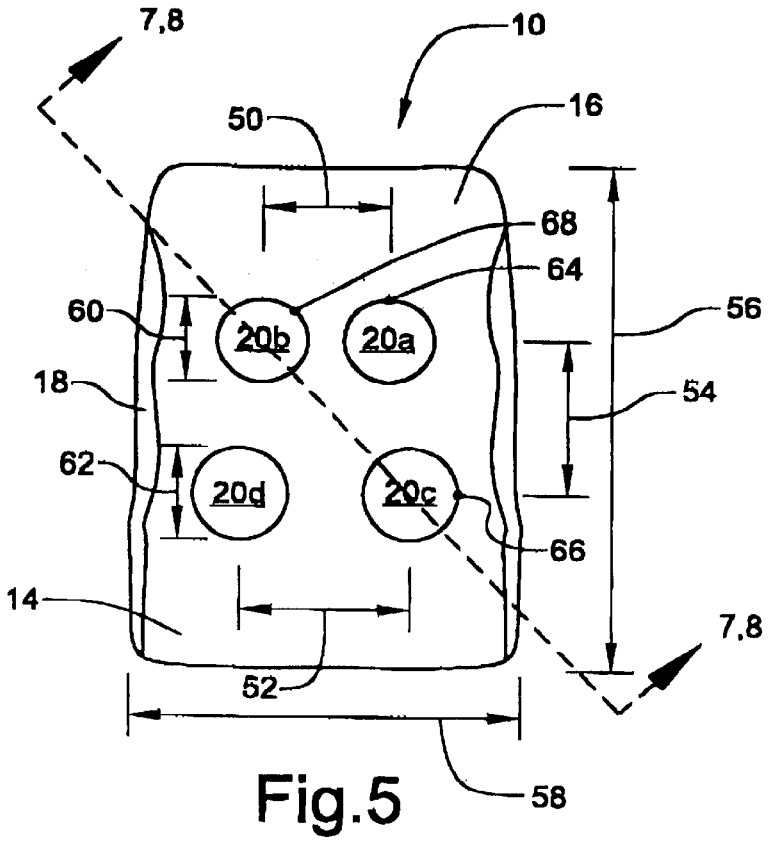
FIG. 5 is a top plane view of the apparatus in FIG. 1.

Referring to FIG. 5, a lateral distance 50 may be prescribed for positioning the upper pressure elements 20*a*, 20*b* with respect to one another. The distance 50 may be selected to correspond to the dimensions of the neck 44 of a user. Similarly, a lateral distance 52 may be selected for spacing the lower pressure elements 20*c*, 20*d* from one another in order to properly position the pressure elements 20*c*, 20*d* with respect to the muscles 46 of the shoulders 48.

The longitudinal distance 54, by which the centers of the pressure elements 20 are separated from one another, corresponds to (e.g. varies with) the height of a user. Similarly, the overall length 56 in a longitudinal direction 22 may be selected in accordance with the stature of a user. For example, a child or adult of modest stature may prefer a lower or thinner crown 38 with respect to a supporting surface, but may require a shorter length 56 in order to properly position the head with respect to the body.

By contrast, a larger user may require an additional overall length 56 in order to accommodate the distance between the skull 45 and the shoulders 48. Thus, the overall length 56 may be adapted, along with the spacing 54 of the pressure elements 20 to fit a range of sizes of a user.

The diameter 60 of the pressure elements 20 may be the same for all pressure elements 20. In one embodiment, the diameter 60 of the upper elements 20*a*, 20*b* may be different from the diameter 60 of the lower pressure elements 20*c*, 20*d*. Again, the spacing 52, 54 between the respective pressure elements 20 may be designed in conjunction with the respective diameters 60, 62 of the pressure elements 20 for any particular bodily member.

In the embodiment of FIG. 5, the proportions of the length 56 and the width 58 of the apparatus 10 may reflect directly the size of a user and the intended use of a particular embodiment in the neck and shoulder region of a user. As a practical matter, the width 58, need not be the full width of the shoulders 48 of a user. Nevertheless, the width 58 and the bodily support portion 14 should be sized for comfort of a user and proper support of the pressure elements 20*c*, 20*d*.

Gauge points 64, 66, 68 may be used for positioning an apparatus 10 with respect to a user. Each pressure element 20 may act as a gauge, felt directly. For example, in one embodiment, an apparatus 10 may be positioned such that the gauge point 64 corresponds to the bottom of the ear of a user. Thus, the pressure elements 20*a*, 20*b*, will not contact the skull with an uncomfortable pressure. Similarly, the gauge point 68 may reduce or eliminate contact with the skull 45. In one embodiment, the gauge point 66 may maintain the orientation of the apparatus 10 with respect to the back of a user.

For example, a user may not be able to see the apparatus 10 while adjusting it. Instead, a user may sense whether or not the pressure elements 20*c*, 20*d* are each positioned symmetrically in a lateral direction 24 and in a longitudinal direction 22 on each side of the back. Thus, maintaining non-contact with the skull at a gauge point 68 may be important. Alternatively, positioning the bottom area of the ear in a longitudinal direction 22 at about the gauge point 64 may also serve to position the apparatus 10. Maintaining symmetry of gauge points 66 near the longitudinal 22 centers of the pressure elements 20*c*, 20*d* may quickly permit a user to position the apparatus 10 by feel in a comfortable and effective location with respect to the neck 44, skull 45, and shoulders 48.

Figure 6:
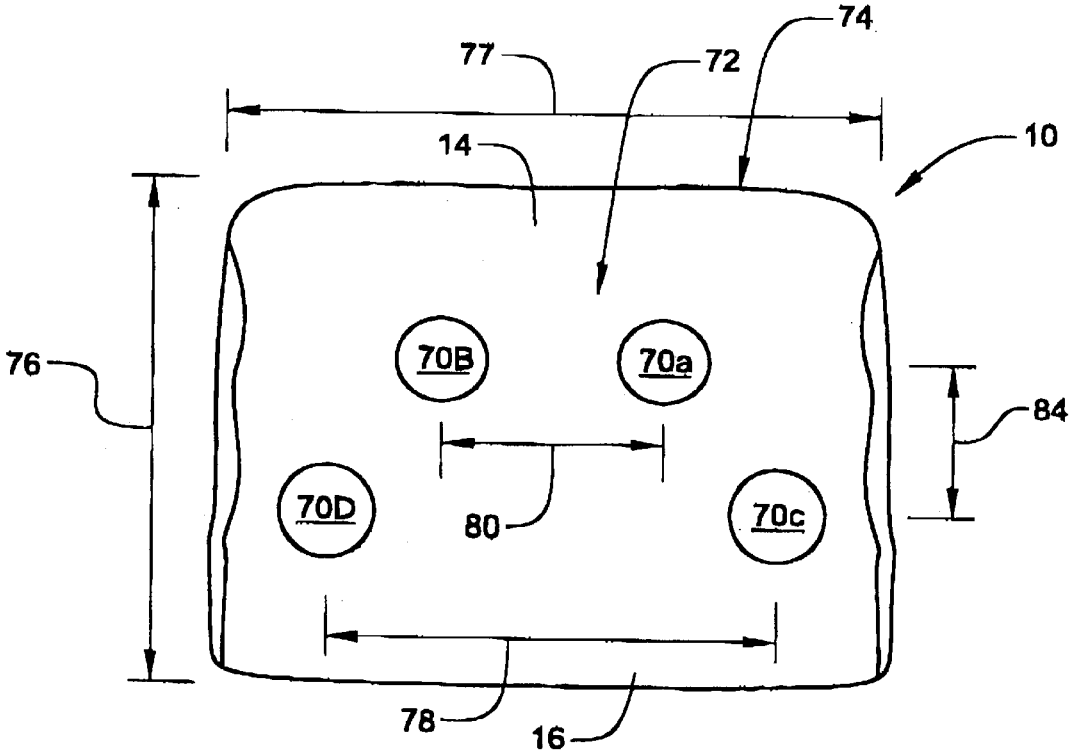
FIG. 6 is a top plane view of an alternate embodiment of an apparatus in accordance with the invention.

Referring to FIG. 6, an alternative embodiment of an apparatus 10 in accordance with the invention may include pressure elements 70 corresponding to the pressure elements 20. Pressure elements 70 (e.g. 70*a*, 70*b*, 70*c*, 70*d*) may be positioned about a thin or shallow region 72 (in a transverse direction 26) in order to apply pressure to locations of the lower back and pelvic area. For example, pressure points may be found in the lower back (e.g. lumbar area) as well as in the hollow just below the outer apex of the hip bone. Accordingly, an elevated region 74 (measured in a transverse direction 26) may be provided for positioning the pressure elements 70*c*, 70*d* with respect to the proper acupressure points, and with respect to the upper pressure elements 70*a*, 70*b*.

In a generalized embodiment, the pressure elements 70 may be arranged to influence pressure points (e.g. acupressure points) associated with any particular bodily member of a user. By rendering the pressure elements 70 movable, more flexibility may be obtained. By rendering the pressure elements substantially fixed (within the bounds of the force and resilience exerted by the base 12 and the pressure elements 70) in a structure 10, minimal knowledge may be required of a user in order to produce desired effects.

Fixing the length 76 and width 77 of any single configuration adapted to a user may be extremely useful and effective. Use may require minimal instructions, training, and skill on the part of a user. Similarly, providing a "fixed" distance 80 between the centers of the upper pressure elements 70*a*, 70*b*, and a fixed longitudinal distance 84 may result in simplified and effective use.

Figure 7:
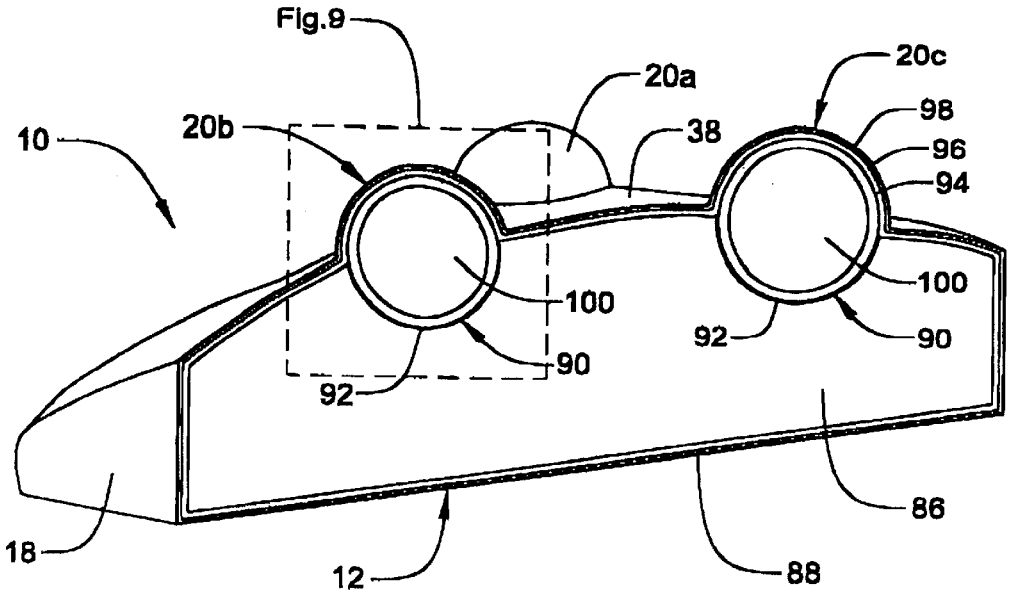
FIG. 7 is a partially cut-away, side elevation view of the apparatus in FIG. 5.
Figure 8:
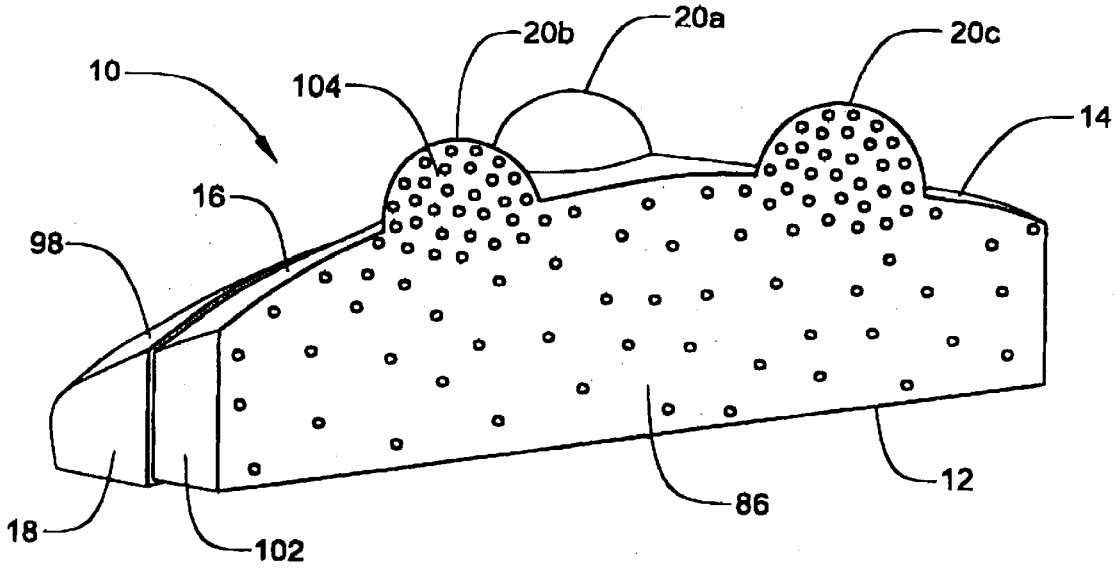
FIG. 8 is a partially cut-away, side elevation view of an alternative embodiment of the apparatus in FIG. 5.
Figure 9:
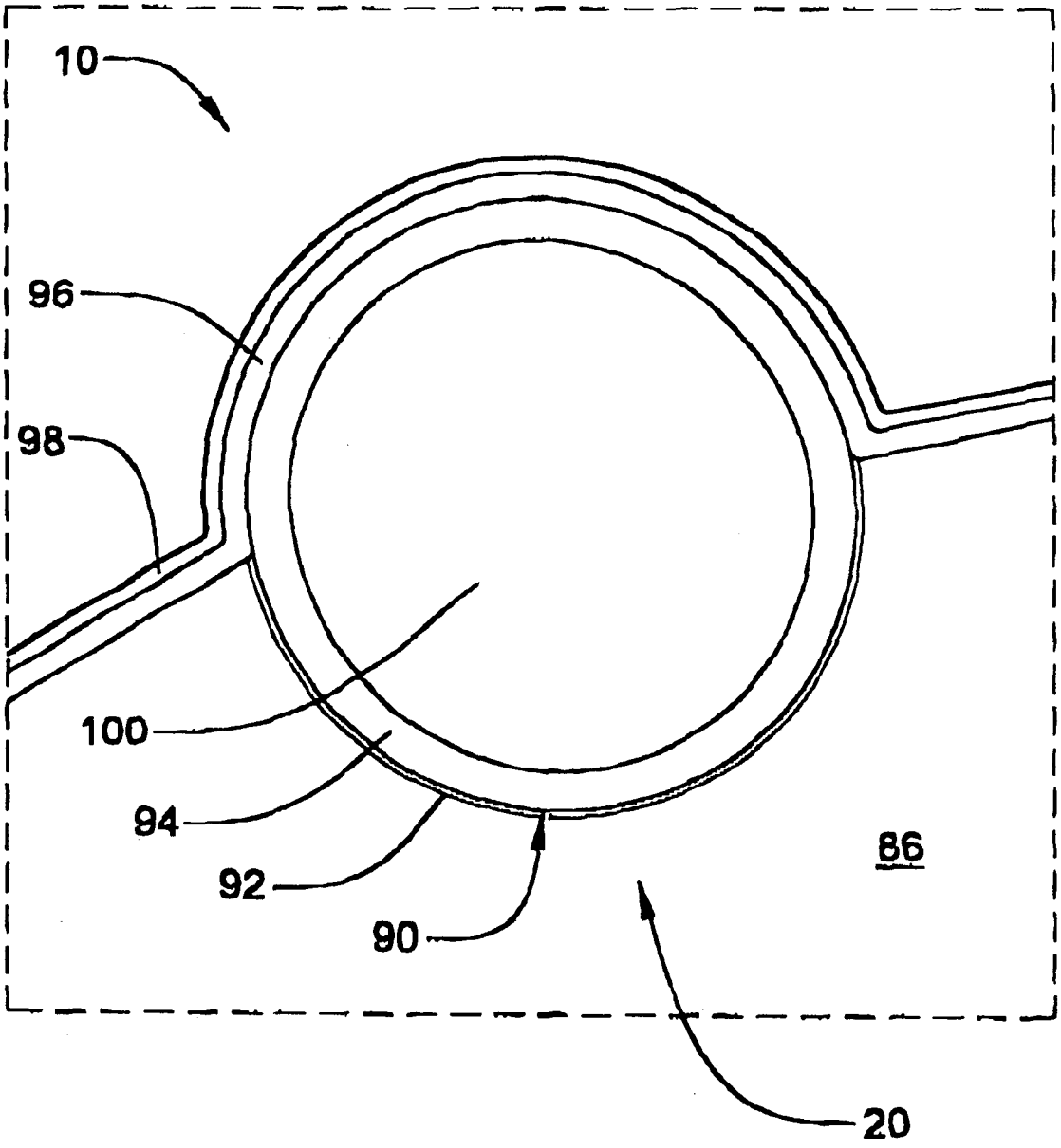
FIG. 9 is a detailed view of a portion of the apparatus in FIG. 7.

Referring to FIGS. 7–9, the bulk region 86 of a base 12 may be bounded by a bottom surface 88. Spheres 90 (or hemispheres 90) may seat within the bulk expanse 86 of the base 12. Each of the spheres 90 or balls 90 may fit into a cavity 92 formed in the bulk material 86 for supporting the spheres 90.

The walls 94 of each sphere 90 may be sized for resilience, transfer of pressure, biasing of pressure, and comfort of localized pressure on a user. For example, the wall thickness of the sphere may be thin and hard. However, an improved design may have a thicker wall 90, substantially more compliant and soft. Nevertheless, a cushion layer 96 applied between the spheres 90 and outer cover or skin 98 may provide additional comfort and distribution of highly localizes stress, in order to transfer the bulk pressure of the hollow 100 of the spheres 90 to the acupressure location of a user.

Referring to FIG. 8, while continuing to refer generally to FIGS. 1–10, an apparatus 10 need not apply pressure in a constant manner over time, but may. That is, a pressurized region 100 or hollow 100 containing a fluid, such as air, maintains pressure. A user may increase or reduce the pressure within the cavity 100 by any suitable means known in the art. Direct injection, built-in pumps, and the like may inject pressure into the cavity 100. However, upon deflection of the wall 94, the pressure within the sphere 90 may increase.

Nevertheless, the pressure may remain constant over an area of contact 40 at all points. Accordingly, the pressure within the cavity 100 applied through the wall 94 is substantially the fluid pressure within the cavity 100. Depending on the dimensions of the wall 94, additional resistance, force, resilience, and the like, may be provided by the spring constant or coefficient of elasticity of the solid elastomeric material from which the wall 94 is constructed.

In designing an apparatus 10, a user has the selection of material, porosity, elasticity coefficient, and other material properties of use in the bulk expanse 86 of the base 12 as design parameters. In addition, the dimensions, diameters, wall thicknesses, and the like of the spheres 90 may be selected along with the specific materials and material properties thereof.

Likewise, a covering layer 98 or cushion layer 98 may be selected for thickness, material properties (e.g. coefficient of elasticity, void fraction, homogeneity, etc.) for relieving highly localized stress. The covering material 98 may be selected to be stiff or soft, compliant or dimensionally stable. Thus, considering the dimensions of FIGS. 5–6 along with the material properties and configurations of FIGS. 7–8, designs of the apparatus 10 may apply precise and localized pressure to acupressure points on a bodily member of a user.

Referring to FIG. 8, one embodiment of an apparatus 10, in accordance with the invention, may rely on molding the bulk expanse 86 of the base 12. The covering material 98 may be optional. The pressure elements 20 may be formed directly from the same material as the bulk expanse 86 of the base 12. In the embodiment in FIG. 8, density of the pressure elements 20 may differ from that of the bulk expanse 86.

For example, a controlled density region 104 may be molded, by relying upon temperature control, resin control, timing, materials, and the like. In one embodiment, the controlled density 104 may be obtained by a preliminary injection of one material followed by a bulk injection of another material. Alternatively, selecting the injection location for gates in an injection process, and other techniques, may provide controlled density regions 104.

In the embodiment in FIG. 8, the controlled density region 104 may be more dense, more stiff, or both, as compared with the bulk expanse 86 of the base 12. Thus, the pressure elements 20 may apply pressure calculated to exceed the overall pressure of the body support portion 13 and extremity support portion 16.

For example, the base 12 must deflect to a greater extent under the pressure elements 20, as compared with a smooth surface. The dimensions of the pressure elements 20 are selected to position the pressure elements 20 in the proper location with respect to an acupressure point while also providing the proper pressures in response deflection from a bodily member resting thereon.

In certain embodiments, the apparatus 10 may rest on a bodily member. In other embodiments, a bodily member may rest on the apparatus 10. In certain embodiments, a harness or tether may actually bind an apparatus 10 to a bodily member of a user in order to maintain the proper deflection to produce the proper pressure by the pressure elements 20 against the acupressure points selected.

For example, a leg wrap may provide unconstricted motion of a leg while applying localized pressure from pressure elements 10. Similarly, an elbow sleeve may surround the elbow portion of the arm wit hat comparatively soft material, easily compliant, as a base 12, with comparatively more force or pressure elements 20 selectively disposed.

Referring to FIG. 9, a detail of the sphere 90 illustrates the cavity 92 in the bulk expanse 86 of the base 12. The wall 94 surrounding a pressurized cavity 100 is also illustrated. A cushion layer 96 may extend underneath the covering material 98 around the base 12 (bulk expanse 86) and the sphere 90. Alternatively, the dimensions of the cushion layer 96 may vary selectively at any point desired in a design, and the cushion layer 96 may cover only the sphere 90 in order to relieve highly localized pressure applied to an acupressure point of a bodily member.

Figure 10:
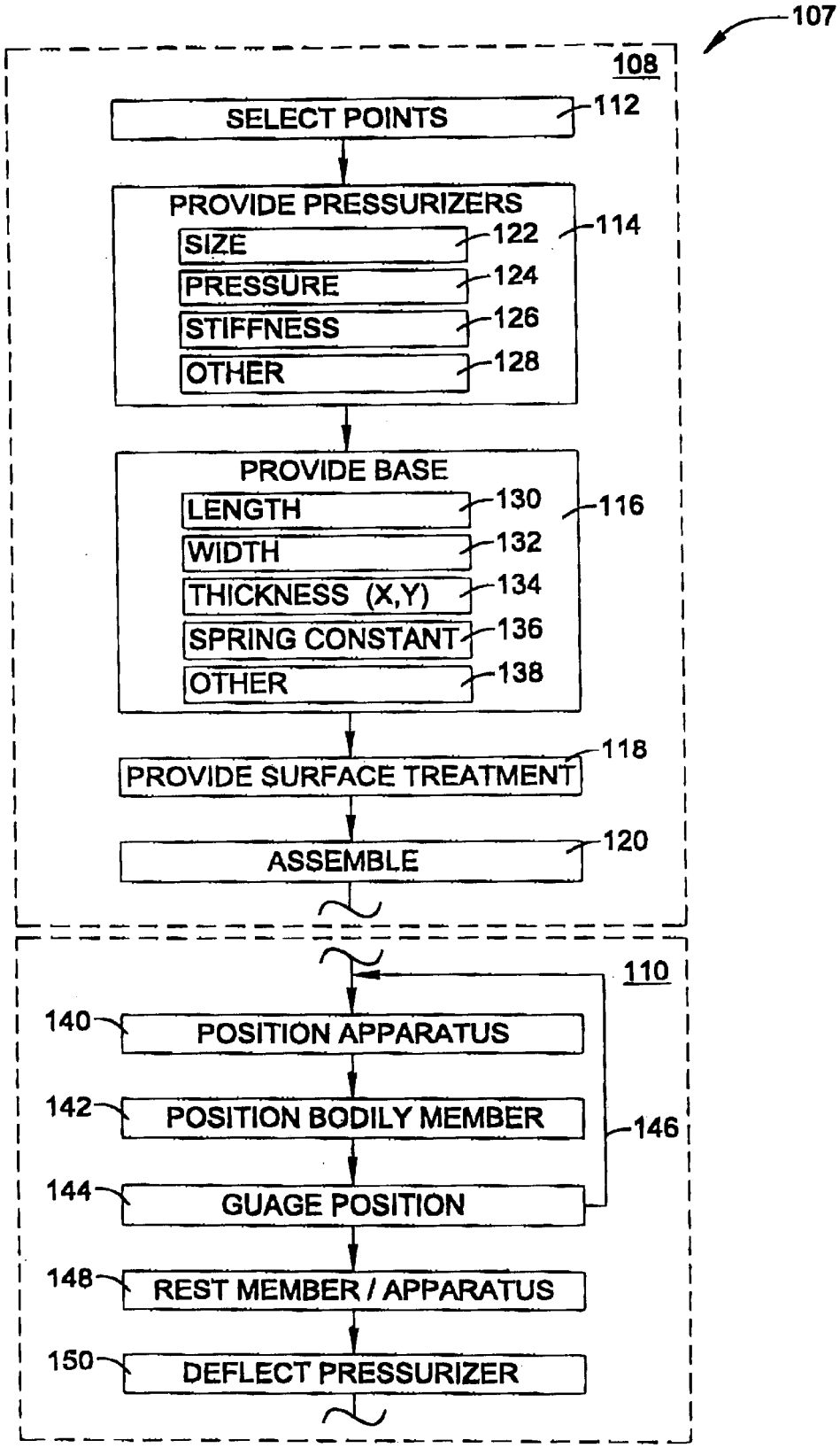
FIG. 10 is a schematic block diagram of a method consistent with certain embodiments of the invention.

Referring to FIG. 10, a method 107 may include methods 108, 110 for manufacture and use of an apparatus 10. In one presently preferred embodiment of a method 107 and apparatus 10 in accordance with the invention, a select step 112 may select acupressure points for application of selective pressure. A provide step 116 may provide a base. The provide surface treatment step 118 may be optional.

For example, in the embodiment of FIG. 8, the covering material 98 is completely arbitrary. For easy removal for cleaning, a cover material 98 may be recommended. Nevertheless, the entire base 12 and pressure elements 20 of the apparatus 10 may be formed in a single molding process, in one embodiment. Thus, the optional assemble step 120 may or may not be required , depending upon the particular embodiment selected.

The provide pressurizers step 108 may include a variety of steps. For example, providing a size 122 may depend upon the select step 112. The select step 112 may be affected by the bodily location, size of a user, age of a user, and the like.

Similarly, providing a pressure 128 may be determined by the foregoing steps as well as the sophistication of a user. For example, a less sophisticated user may require lower pressure and perhaps a fixed pressure. A more sophisticated user may find additional pressure useful, and may be able to provide direct user control of pressure in the spheres 90.

The stiffness on the pressure elements 20 or pressurizers 20 refers to the material properties of the sphere 90, and particularly the modulus of elasticity. Other factors 128 may also be selected. For example, the dimensions of the pressure elements 20 and the manufacturing processes for reliability, predictability, and the like may be considered.

Providing 130 a length 56, 76 for the base may be dependent upon the size of an anticipated user. Similarly, the width step 132 or selection 132 or providing 132 a width 58, 77, depends upon not only the size of the user, but the particular bodily member that is to be affected by the apparatus 10. Thus, the length 130 and width 132 steps may be adapted to the size of the user and the particular expected dimensions of the neck 44 and shoulders 48 thereof.

The thickness step 134 or selection 134 of a thickness, may require selection of a thickness (extension in a transverse direction 26) of the body support portion 14, extremity support portion 16, and the crown 38. Thus, the thickness step 134 may require a multi-dimensional curve. The angles of curvature with respect to a longitudinal direction 22, and a lateral direction 24 may be important in this regard. In the presently preferred embodiment of FIG. 3, adapted for use in the shoulder and neck region, the application of pressure by the pressure elements 20 and locating the pressure elements 20 are served by the slopes and dimensions of the entire base 12.

The spring constant step 136 involves selection of a material having the particular porosity and effective stiffness or resilience of the base 12. Other parameters 138 may be selected that effect the overall provision 116 of a base 12. For example, providing 116 a base 12 may subsume the provide step 114 associated with the pressure elements 20. For example, in the embodiment of FIG. 8, steps 114, 116 may be very closely integrated.

The method 110 for using the apparatus 10 may include positioning 140 the apparatus 10 with respect to a bodily member of a user. Nevertheless, the position step 140 may merely initiate positioning 140 on a suitable surface such as a bed, floor, rug, or the like.

The position step 142 positions a bodily member of a user with respect to the apparatus 10. The position step 142 may involve a certain amount of trial and error. For example, the engage step 144 may involve checking, by a user, the relative position of a bodily member of a user with respect to the apparatus 10. Accordingly, a return 146 or feedback 146 may result in either a change of the position 140 of the apparatus, a change in positions 142 of the bodily member, or both.

Upon satisfactory gauging 144, a user may have obtained the desired relative position 140 of the apparatus and the position 142 of a bodily member thereon. The handles 30, straps 30 in one presently preferred embodiment, facilitate movement of the apparatus 10 without recourse to sight. That is, a user need not see the apparatus 10 while moving it. Rather, the gauge points 64, 66, 68 may be detected as pressure elements 20 are felt. The symmetry may be felt and detected extremely well by many users. Moreover, the comparative pressure or stress felt due to application of the pressure elements 20 may typically be readily felt after a minimal experience or exposure of a user to the apparatus 10.

The rest step 148 may involve resting the bodily member of a user, a bodily member such as the neck, head, leg, etc., or resting 148 the apparatus 10. For example, the apparatus 10 may be placed on couch, on a ramp, on a level floor, in an elevated position, in a tilted position, in a lowered position, or the like. In one presently preferred embodiment, the apparatus in FIG. 3 may be laid on a comfortable floor (e.g. rug or carpet) providing a stable platform for relaxation.

As a practical matter, the body appears to relax more with the constant pressure of the apparatus 10 than with motion, such as vibration, and the like. It appears that the steady, predictable pressure of the pressure elements 20 provides relaxation of muscles affected by the respective acupressure points. The stable, flexible support of the base 12 also appears to aid relaxation of a user.

With the rest step 148 comes an immediate and a residual deflection step 150. The deflection or deflect step 150 deflects the pressurizers 20. The deflection 150 also may deflect the base 12. Thus, the design of the stiffness 126 or spring constant 136 of the pressure elements 20 and base 12 give the result of the deflect step 150. The deflect step involves deflection of the pressurizers 20, which may have additional deflection of translation (motion) due to the softness or spring effect of the material of the bulk expanse 86 of the base 12.

In one presently preferred embodiment, an apparatus 10 in accordance with the invention may be used in accordance with the methods 107, 108, 110 of FIG. 10 to provide effective relaxation in a matter of a few minutes. For example, initial discomfort from localized pressure may be resolved within approximately three minutes. Relaxation may occur within five to fifteen minutes. Many users find that comfort is substantial within three to five minutes, and relaxation is substantial within seven to fifteen minutes.

The foregoing discussion clearly demonstrates that the present invention may provide several advantageous individual features and combinations thereof The invention provides, for example, localized pressurization of acupressure points. Acupressure points may be easily located by gauging the pressure elements 20 of the apparatus 10 with respect to particular body locations.

A minimum of training is required in order for a user to be effective in recognizing the proper location of the pressure elements 20 with respect to a bodily member such as the neck 44, shoulders 48, and the like. Pressure may be provided across the localized pressurization area 40 associated with each pressure element 20. The area and pressure of each pressurized area 40 may be designed into the geometry and materials of each pressure element 20.

The present invention may be embodied in other specific forms without departing from the structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed and desired to be secured by United States Letters Patent is:

1. An apparatus for selectively applying pressure to a bodily member of a user, the apparatus comprising:

a base for supporting the apparatus on a surface, the base having a back support portion, a neck support portion, a longitudinal direction, and a lateral direction with a proximal end and a distal end longitudinally opposite each other;

the back support portion configured to support the back of a user proximate the proximal end;

the neck support portion configured to support the neck of a user proximate the distal end;

a first pair of pressure elements equally spaced a first length from the distal end, spaced laterally apart a first width, and protruding a distance from the base, the distance being selected to be effective to apply pressure to soft tissue of the neck of a user proximate the skull; and a second pair of pressure elements, equally spaced from the distal end a second length, greater than the first length spaced a second width apart, greater than the first width, and positioned with the first pair to simultaneously apply pressure to soft tissue of a back and neck respectively of a user.

2. The apparatus of claim 1, further comprising a gauge portion effective to mark the apparatus and to identify to a user a location for the first pressure element with respect to the bodily member.

3. The apparatus of claim 2, wherein the second pressure element is sized and spaced with respect to the first pressure element to effectively gauge the positions of the first and second pressure elements for proper placement thereof with respect to the bodily member by a user.

4. The apparatus of claim 1, wherein the second pressure element is effective to gauge the position of the first pressure element.

5. The apparatus of claim 1, further comprising a handle secured to the base for facilitating positioning of the apparatus by a user in the absence of visual feedback of the location of the pressure element.

6. The apparatus of claim 1, wherein the pressure element is selectively hollow, and sealed to sustain an internal pressure therein, the pressure being selected to be effective to relax a muscle of a user in response thereto.

7. The apparatus of claim 6, wherein the pressure element is further structured to have a wall surrounding the hollow portion, the wall being positioned to deflect in response to positioning against the bodily member, and having a thickness selected to apply a substantially uniform pressure to the bodily member over a contact area corresponding to the deflection.

8. The apparatus of claim 7, wherein the wall is substantially contiguous and uniform, surrounding a uniform and contiguous hollow portion having a single cavity therein.

9. The apparatus of claim 1, wherein the base, the body support portion, extremity support portion, and the pressure member are formed of a continuous expanse of a single material.

10. The apparatus of claim 9, wherein the single material is selected from expanded polymeric resin molded to form the pressure element.

11. The apparatus of claim 10, wherein the expanded polymeric resin is molded to form a substantially uniform cell size therein.

12. A method for applying therapeutic pressure to a bodily member of a user by a user, the method comprising:

providing a base having lateral and longitudinal directions and having distal and proximate ends longitudinally opposite one another;

providing a first pair of pressure elements secured to the base equidistant from the distal end by a first length, and laterally separated from one another by a first width;

providing a second pair of pressure elements secured to the base equidistant from the distal end by a second length, greater than the first length, and laterally separated from one another by a second width, greater than the first width;

positioning the base to orient the first and second pairs, protruding therefrom, to simultaneously apply pressure to soft tissue of the neck and upper back, respectively, of a user.

13. The method of claim 12, further comprising providing a gauge for locating a suitable first site on a neck of a user for receiving contact from the first pair.

14. The method of claim 12, further comprising providing a gauge for positioning the first pair with respect to the first site.

15. The method of claim 12, further comprising deforming the pairs of pressure elements to provide pressure against the skin of a user.

16. The method of claim 12, wherein positioning further comprises supporting the head of a user on the base, proximate the distal end thereof, and supporting the upper back of a user on the base proximate the proximal end thereof.

* * * * *